United States Patent [19]

Griffith

[11] Patent Number: 4,667,704

[45] **Date of Patent: * May 26, 1987**

[54] HEALD ROD RETENTION DEVICE

[75] Inventor: John D. Griffith, Cleadon, England

[73] Assignee: Bonas Machine Company Limited, England

[ * ] Notice: The portion of the term of this patent subsequent to Jun. 10, 2003 has been disclaimed.

[21] Appl. No.: 809,481

[22] Filed: Dec. 16, 1985

[30] Foreign Application Priority Data

Dec. 21, 1984 [GB] United Kingdom ..... 84 32476

[51] Int. Cl.[4] ..... D03C 3/06; D03C 3/20

[52] U.S. Cl. ..... 139/65; 139/455

[58] Field of Search ..... 139/59, 64, 65, 455

[56] References Cited

U.S. PATENT DOCUMENTS 3,265,096 8/1966 Zangerle et al. ..... 139/59

3,529,635 9/1970 Hoark ..... 139/68

FOREIGN PATENT DOCUMENTS 2106549 4/1983 United Kingdom ..... 139/59

*Primary Examiner*—Henry S. Jaudon

*Attorney, Agent, or Firm*—Jones & Askew

[57] ABSTRACT

A heald rod retention device comprising an elongate body having a first body portion adapted to guide reciprocal movement of the terminal end portion of a heald rod and a second body portion provided with a first latch formation for engagement with a second co-operating latch formation on the heald rod, the heald rod being guided by the first body portion so that during reciprocation the second latch formation moves passed the first latch formation without engagement, at least one solenoid activated magnetic pole piece mounted on the second body portion and extending along the path of reciprocation of the heald rod and which on activation of the solenoid causes deflection of the terminal end portion of the heald rod during its reciprocal movement to bring the first and second latch formations into engagement, and stop means for limiting the amount of deflection of the heald rod so as to prevent contact between the heald rod and the pole piece.

10 Claims, 5 Drawing Figures

HEALD ROD RETENTION DEVICE

The present invention relates to a heald rod retention device for a weaving loom.

The present invention is particularly concerned with a heald rod retention device for use in an electronic control patterning system of a weaving loom. In such a loom each wrap thread is acted upon by a heald eye and the shed position of each heald eye is controlled by a single heald rod retention device. Accordingly, the loom includes a large number of rod retention devices which correspond in number to the maximum number of wrap threads the loom is capable of handling.

According to the present invention there is provided a heald rod retention device comprising an elongate body having a first body portion adapted to guide reciprocal movement of a heald rod and a second body portion provided with a first latch formation for engagement with a second co-operating latch formation on the heald rod, the heald rod being guided by the first body portion so that during reciprocation the second latch formation moves passed the first latch formation without engagement, at least one solenoid activated magnetic pole piece mounted on the second body portion and extending along the path of reciprocation of the heald rod and which on activation of the solenoid causes deflection of the heald rod during its reciprocal movement to bring the first and second latch formations into engagement, and stop means for limiting the amount of deflection of the heald rod so as to prevent contact between the heald rod and the pole piece.

Reference is now made to the accompanying drawings, in which.

Figure 1:
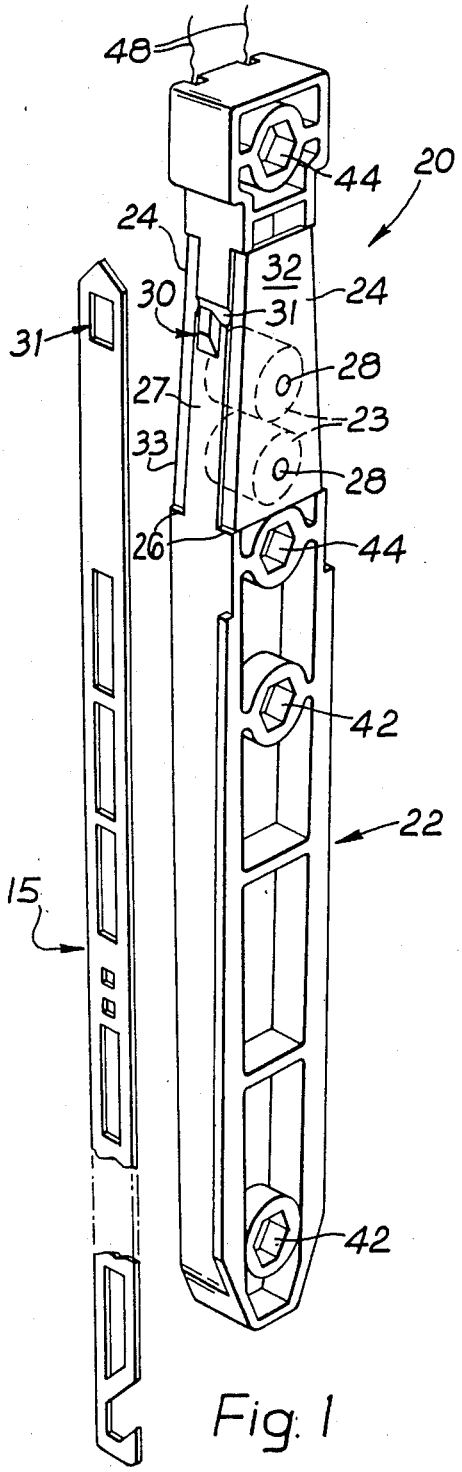
FIG. 1 is a front perspective view of a heald rod retention device according to the present invention.
Figure 2:
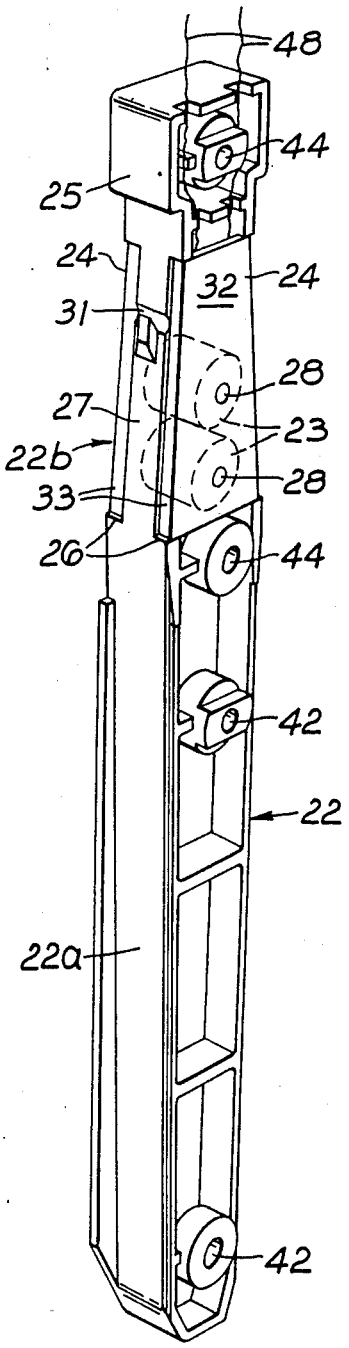
FIG. 2 is a rear perspective view of the retention device illustrated in FIG. 1.
Figure 3:
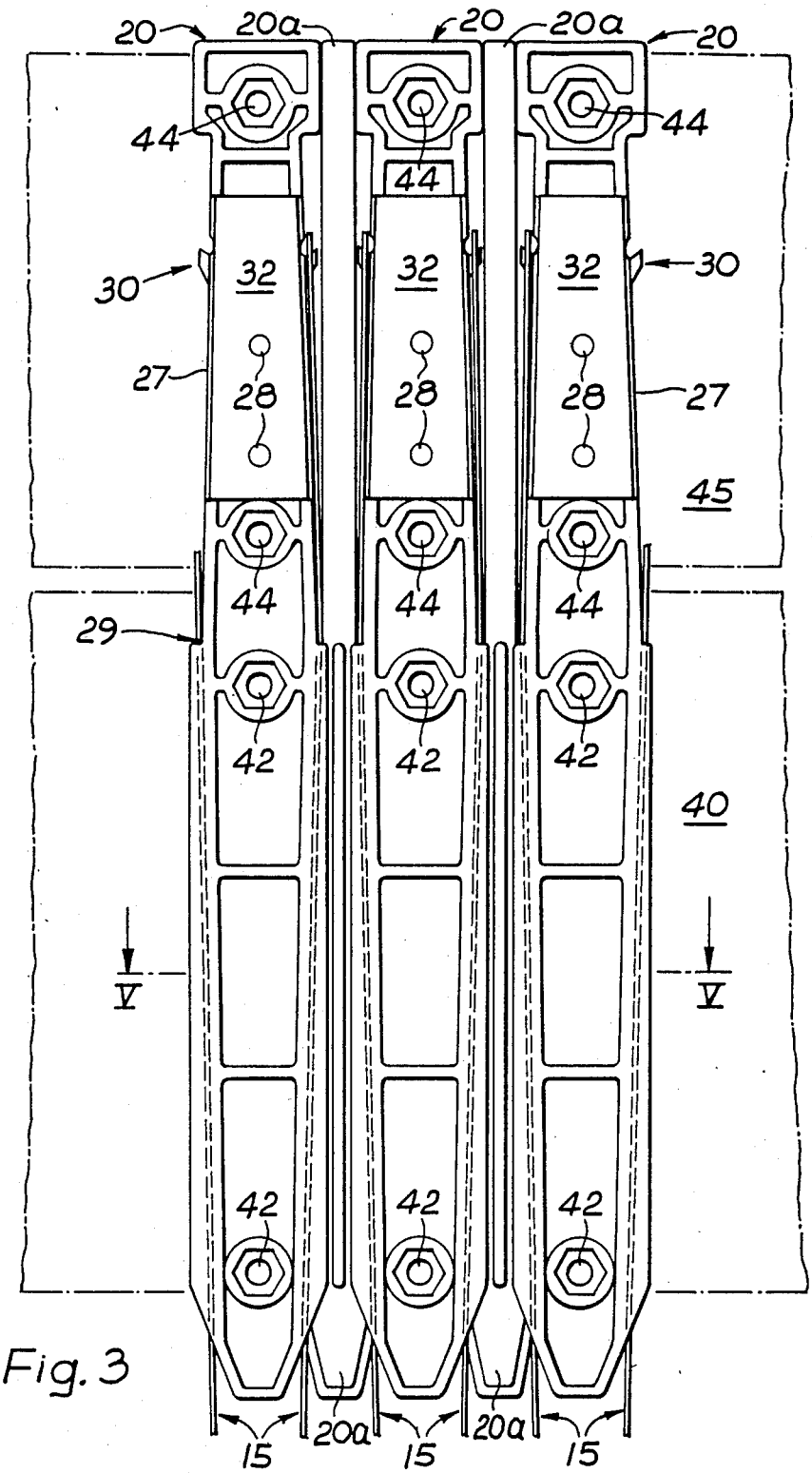
FIG. 3 is a front view showing a plurality of the retention devices of FIG. 1 side by side.

Referring initially to FIG. 3 there is shown a plurality of heald rod retention devices 20 which are arranged side by side, each retention device co-operating with a given pair of heald rods 15 for operating lifting of an associated heald eye (not shown) in a manner as described in our U.K. Pat. No. 2047755. Accordingly, across the width of the loom a plurality of heald rod retention devices 20 are arranged which correspond in number to the maximum number of warp ends which the loom is capable of handling. Accordingly a large number of retention devices have to be provided for each loom. The heald rods 15 are preferably formed as a metal pressing from a suitably resilient steel.

The retention devices 20 are arranged side by side as shown in FIG. 3 with a spacing member **20*a* located therebetween. Each neighbouring spacing member and retention device define therebetween a passageway for guiding the longitudinal reciprocation of a heald rod 15** in the same manner as described in our European Patent Application No. 84301486.1.

The pair of heald rods 15 associated with a given retention device are raised and lowered alternatively in a conventional manner by a pair of knife bars (not shown). The retention devices are provided with a latch formation in the form of a hook 30 for co-operating with a latch formation in the form of aperture 31, on each heald rod. Each heald rod, when selected, is deflected on its downward stroke toward the side face of the retention device so as to bring the co-operating latch formations into engagement with one another. When both heald rods are retained on their associated hooks 30 (as seen on the central device 20 in FIG. 3), the heald eye will reside in one shed position, otherwise it will reside in the other shed position.

Each retention device 20 is constructed from three basic components, viz. a body portion 22, a pair of solenoids 23 and a pair of pole pieces 24. The body portion 22 is moulded from a plastics material by injection moulding and so may be produced in large numbers whilst retaining dimensional accuracy. The body portion 22 includes a first or lower body portion **22*a* which, in co-operation with spacing members 20*a* define the passageway for guiding longitudinal reciprocation of a heald rod 15, and also includes a second or upper portion 22*b* on which is located the pair of pole pieces 24. The upper portion 22*b* preferably has a terminal end formation 25 which is used for mounting of a circuit board 45** which is described later in more detail.

The sides of the upper body portion taper inwardly toward the teminal end formation 25 and each side of the upper body portion is provided with a pair of longitudinally extending recesses 26 which define a raise central side portion 27. The hooks 30 are located at a suitable position on each of the raised side portions 27 and are moulded integrally with the body and are also formed of the same plastics material. Accordingly the position of the hook on the body portion is accurately located.

A groove 31 is located at the juncture of the upper wall of the hook and the side face of the body portion in order to ensure that no flashings occur during the moulding process which would otherwise interfere with seating of the heald rod onto the hook formation.

The sides of the lower portion **22*a* taper towards the lower end of the body portion and the sides of the upper portion 22*b* taper toward the upper end of the body. There is thus a transition point or ridge 29** on each side of the body portion about which the heald rod is bent during deflection. If the solenoids are not activated, the heald rods associated with a given retention device reciprocate along a path as determined by the sides of the lower body portion which diverges away from the sides of the upper body portion and so during such reciprocation the respective latch formations on the device and rods pass one another without engagement.

Each pole piece 24 is formed from a suitable magnetic material which is shaped to define a planar body portion 32 provided with a pair of opposed longitudinally extending side walls 33.

Advantageously each pole piece is formed by a stamping operation so that they may be accurately made in large quantities.

A pair of pole pieces 24 are seated upon the upper body portion with the side walls 33 of each pole piece 24 being accommodated in a pair of recesses 26. The distance between the walls 33 is preferably chosen so that the pole piece is a press fit onto the body portion 22. The upper body portion is provided with apertures (not shown) through each of which a solenoid 23 passes, each solenoid 23 being secured to pole pieces 24 by a rivet 28 which also ensures a good magnetic contact between the solenoid 23 and the pole pieces 24. The windings of the solenoids 23 are such that on activation one pole piece 23 form a south pole and the other pole pieces forms a north pole.

In addition, the depth of the recesses 26 and the thickness of walls 33 are chosen so that the raised central portion 27 projects above the outer faces of walls 33 when the pole pieces are seated on the body 22.

Thus the pole pieces 24 are attached to the body portion by virtue of their longitudinal side walls embracing the body portion 22 and by virtue of rivets 28.

The longitudinal position of the recesses 26 is preferably chosen so that the pole pieces extend both above and below the hooks 30. In this way, at the time of energisation of the solenoids, the pole pieces act upon the maximum length of heald rod 15 located above the transition point 29 between the upper and lower body portions and about which point the heald rod 15 is bent. Accordingly during deflection of the rod a minimum resistance to deflection is encounted which thereby maximises the effect of the pole pieces.

As mentioned above, the central raised portion 27 projects above the outer faces of the side walls 33 and so accordingly when the solenoids are activated to deflect a heald rod toward the pole pieces, the deflected portion of the rod bears against the raised portion 27 of the body portion but does not contact the outer faces of the pole pieces. Accordingly when the heald rod is supported by the hook 30 an air gap is provided between the pole pieces and the heald rod which prevents the heald rod acting as a magnetic keeper and so avoids the possible problem of the heald rod sticking in its deflected position. Thus when the heald rod is lifted off the hook 30 it deflects under its own bias away from the side face of the body portion so as to clear the hook 30 on its downward stroke, providing of course that the solenoid has not been re-activated.

It will be appreciated therefore that the raise central portion 27 acts as a stop to limit the amount of deflection of the heald rod so as to prevent contact between the deflected heald rod and the pole pieces.

Figure 4:
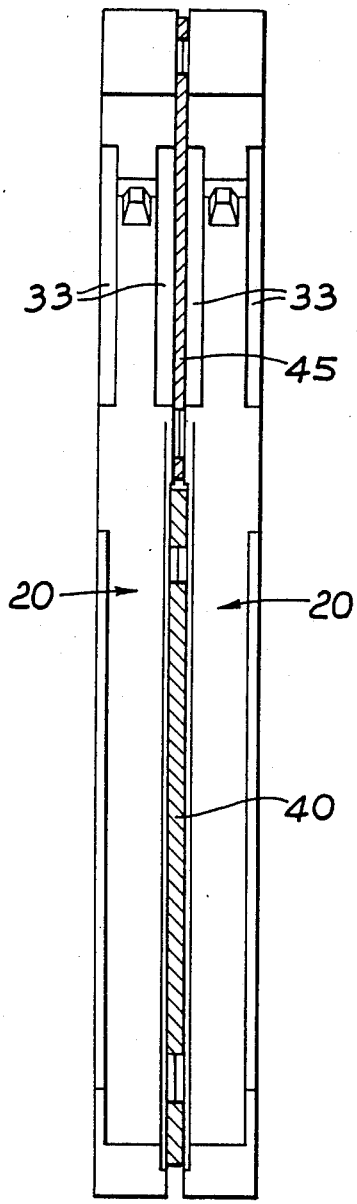
FIG. 4 is a side view of the arrangement shown in FIG. 3.
Figure 5:
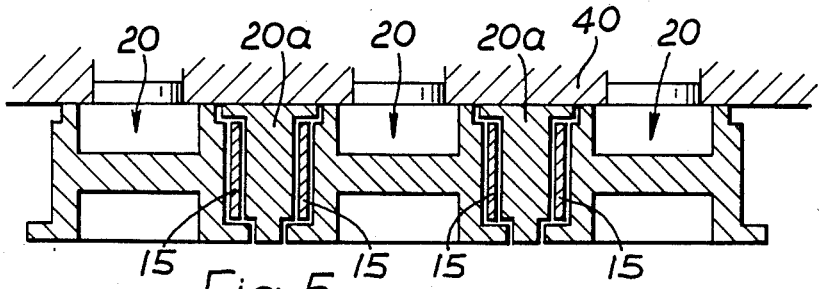
FIG. 5 is a sectional view taken along line V—V in FIG. 3.

As seen in FIG. 4 the retention devices 20 are conveniently mounted in the loom by being attached to a rigid support bar 40 which forms part of the loom frame and which extends laterally across the warp sheet. Bolt holes 42 are provided in the body portion to enable the body portion to be bolted to bar 40. As seen in FIG. 4 the retention devices 20 are mounted on both sides of the support bar 40 in a back to back fashion.

The body upper portions **22*b* of the retention devices advantageously project above the support bar 40 and are used to support a circuit board 45 by the body portions by being bolted thereto through bolt holes 44. This form of connection gives rigidity to the board 45 and enables a thin gauge board to be used. Use of thin gauge boards is advantageous both from a cost point of view and also an assembly point of view since it is possible with thin gauge boards to use connections on the board which are formed by through plating. The solenoid tails 48 are conveniently positioned to be soldered directly onto the circuit board. A further advantage of this assembly is that any longitudinal warping of the upper body portions caused during the moulding process is removed by bolting the upper body portions at their terminal ends back to back across a flexible board and by bolting the lower body portions to the rigid bar 40**.

What is claimed is:

1. A heald rod retention device comprising an elongate body having a first body portion adapted to guide reciprocal movement of the terminal end portion of a heald rod and a second body portion provided with a first latch formation for engagement with a second co-operating latch formation on the heald rod, the heald rod being guided by the first body portion so that during reciprocation the second latch formation moves passed the first latch formation without engagement, at least one solenoid activated magnetic pole piece mounted on the second body portion and extending along the path of reciprocation of the heald rod and which on activation of the solenoid causes deflection of the terminal end portion of the heald rod during its reciprocal movement to bring the first and second latch formations into engagement, and stop means for limiting the amount of deflection of the heald rod so as to prevent contact between the heald rod and the pole piece.

2. A device according to claim 1 wherein the first latch formation is formed integrally with the second body portion.

3. A device according to claim 2 wherein the first latch formation is defined by a hook.

4. A device according to claim 1, or wherein the first latch formation is located between the longitudinal extremities of the pole piece.

5. A device according to claim 1 wherein the body is moulded in one-piece from a suitable plastics material.

6. A device according to claim 1 wherein the pole piece includes a planar body portion having a pair of opposed side walls which taper toward one another and which are located in complementary seats formed in the second body portion, one or more solenoids being connected to the planar body portion for magnetically energising the pole piece.

7. A device according to claim 6 wherein a pair of said pole pieces are provided, the pole pieces being arranged so that the planar body portion of one pole piece extends across the front face of the said body and the planar body portion of the other pole piece extends across the rear face of said body, the side walls of the pole pieces located on each side of said body being spaced from one another.

8. A device according to claim 1 wherein the stop means is defined by a stop face formed integrally with the second body portion.

9. A heald eye control system including a pair of heald rods operatively connected to a heald eye, the pair of heald rods being reciprocally driven 180° out of phase and a heald rod retention device according to claim 1 for selectively retaining both rods of said pair at a predetermined position of the reciprocal movement.

10. A loom including a plurality of heald rod retention devices according to claim 1, the first body portion of each retention device being rigidly connected to a rigid support member forming part of the frame of the loom, the second body portion of each retention device being arranged to project above the support member and a circuit board secured to and supported by the second body portions.

* * * * *